US006461275B1

(12) United States Patent
Wang et al.

(10) Patent No.: US 6,461,275 B1
(45) Date of Patent: Oct. 8, 2002

(54) ELEVATINGLY FOLDING UNIT OF ELECTRIC EXERCISE TREADMILL

(76) Inventors: Leao Wang, No. 1, Lane 233, Sec. 2, Charng Long Rd., Taiping, 411 (TW); Peter Wu, No. 1, Lane 233, Sec. 2, Charng Long Rd., Taiping, 411 (TW)

( * ) Notice: Subject to any disclaimer, the term of this patent is extended or adjusted under 35 U.S.C. 154(b) by 3 days.

(21) Appl. No.: 09/698,651

(22) Filed: Oct. 30, 2000

(51) Int. Cl.[7] ..... A63B 22/00
(52) U.S. Cl. ..... 482/8; 482/51; 482/54
(58) Field of Search ..... 482/8, 51, 54

(56) References Cited

U.S. PATENT DOCUMENTS 5,860,893 A * 1/1999 Watterson et al. ..... 482/54
5,899,834 A * 5/1999 Dalebout et al. ..... 482/54
5,921,893 A * 7/1999 Hurt ..... 482/54

* cited by examiner

*Primary Examiner*—Glenn E. Richman
(74) *Attorney, Agent, or Firm*—Kuo-Hsiung Chiu

(57) ABSTRACT

The present invention relates to an elevatingly folding unit of an electric exercise treadmill having a main frame, a deck frame, a belt-driving assembly and an elevatingly folding unit. The deck frame is interposed between two foot seats, including a deck and a continuous belt. And the belt-driving assembly is disposed at one end of the deck frame to drive the continuous belt for a cyclical rotation. In addition, the elevatingly folding unit is used for the deck frame to perform an elevating or a folding action. This folding unit makes use of a servomotor to drive the transmission spindle through a gearbox such that a slide shaft is movable forward and backward. The slide shaft is pivoted with two elevating rods while the other end thereof is pivotally mounted on a fixing shaft of the deck frame. When the slide shaft moves forward and backward, a relatively elevating action will be created at one end of the deck frame. Moreover, when the slide shaft moves, the folding support pivoted at one end of the foot seat and a movable support are pivotally joined with the deck frame such that a relatively folding action of the deck frame is created.

8 Claims, 6 Drawing Sheets

ELEVATINGLY FOLDING UNIT OF ELECTRIC EXERCISE TREADMILL

BACKGROUND OF THE INVENTION

1. Field of the Invention

The present invention relates to an elevating folding unit for an electric exercise treadmill, and more particularly, to an exercise treadmill whose deck frame is driven by an elevating folding transmission unit for creating an elevating and a folding effect.

2. Description of the Prior Art

The elevating and the folding units of the conventionally produced exercise treadmill are both manually or electrically operated, or one is manually and the other is electrically operated. No matter how they are operated, they are impractical in using so that the purchasing and using desire of the user is tremendously reduced. However, the electrically operated type is too expensive that the consumer who desires to purchase it can't afford it because each of the units must be fitted with a motor plus related transmission assembly. The extra expenses of these components will rest upon the consumers so that the competitiveness of the product is much reduced. SUMMARY OF THE INVENTION It is a primary object of the present invention to provide an elevating folding unit for an exercise treadmill in which a deck frame can be driven by an elevating folding unit to achieve an elevating or a folding effect.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
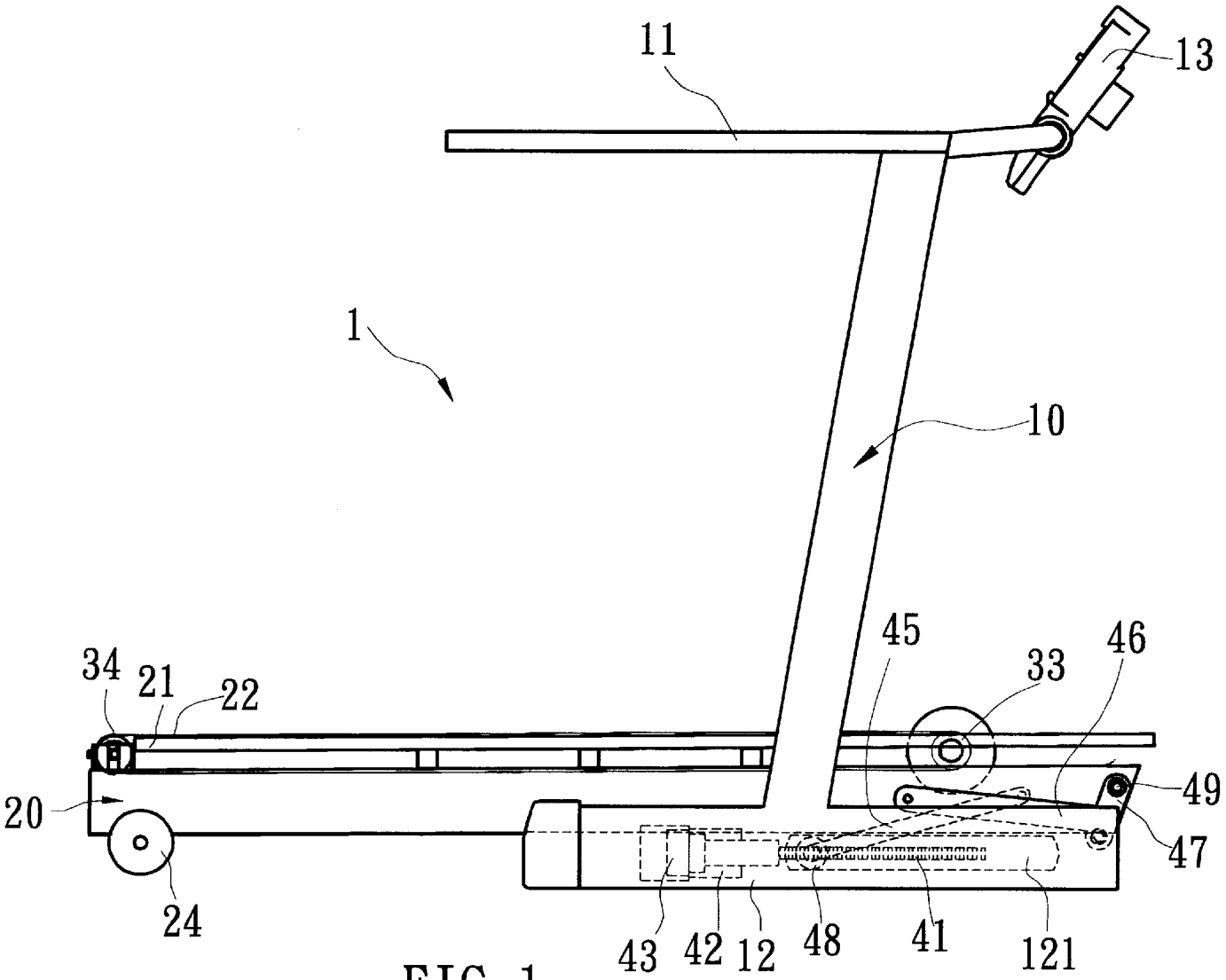
FIG. 1 is an assembly plan view of a first preferred embodiment of the present invention.
Figure 2:
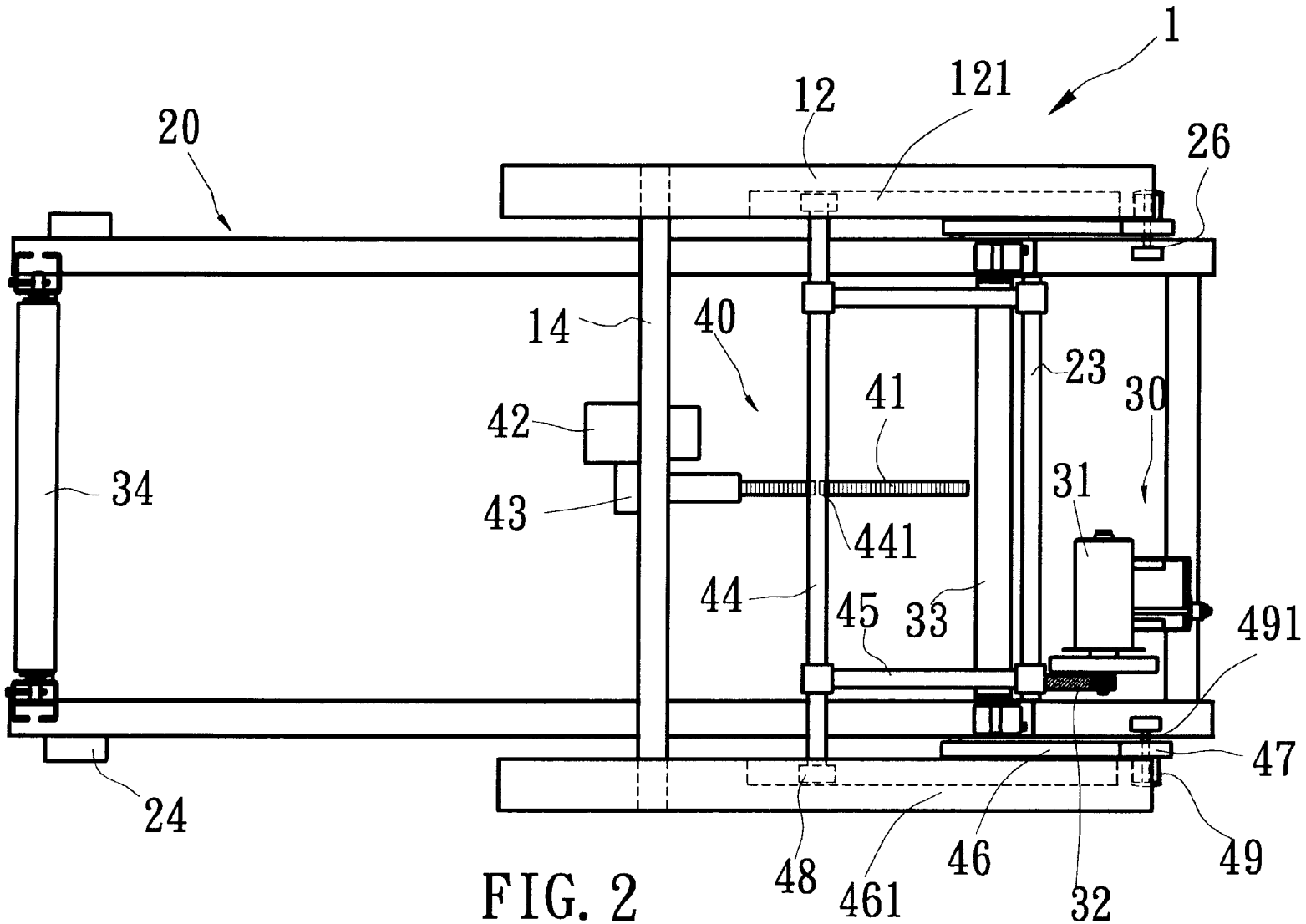
FIG. 2 is an assembly bottom view of the first preferred embodiment of the present invention.

First of all, referring to FIGS. 1 and 2, the elevatingly folding unit of the electric exercise treadmill 1 in accordance with the present invention primarily includes a main frame 10, a deck frame 20, a belt-driving assembly 30 and an elevatingly folding unit 40. The deck frame 20 performs an elevating and a folding movement by means of the elevatingly folding unit 40 to meet the different needs of users.

The main frame 10 is substantially upright, having an inverted U-handrail 11 and two opposing foot seats 12. A control panel 13 is mounted on the inverted U-handrail 11. A fixing seat 14 is arranged between two foot seats 12, and a slide rail 121 is respectively disposed at two opposing inner sides.

The deck frame 20 is interposed between two foot seats 12 and includes at least a deck 21 and a continuous belt 22. The continuous belt 22 is mounted around the deck 21. A fixing shaft 23 is laterally positioned at the rear rim thereof, and a pulley 24 is fitted at the rear end thereof. A hole 25 is disposed at a prearranged position of two sides of the front end thereof.

The belt-driving assembly 30 is used to drive the continuous belt 22 to rotate, and is respectively arranged at the front and the rear end of the deck frame 20. In addition, the belt-driving assembly 30 is composed of a main motor 31, a belt pulley 32, a drive shaft 33 and a driven shaft 34. The main motor 31 drives the belt pulley 32, whereby the drive shaft 33 is brought into rotation by the belt pulley 32. Thereafter, the drive shaft 33 is adapted to the driven shaft 34 disposed at the rear end of the deck frame 20 to bring the continuous belt 22 into a cyclical rotation.

The elevatingly folding unit 40 is mounted on the fixing seat 14 of the main frame 1, including:

- a servomotor 42 and a gear box 43 for bringing a transmission spindle 41 into rotation;
- a slide shaft 44, two elevating rods 45, two folding supports 46 and two movable supports 47 which can be driven by the transmission spindle 41 for performing the sliding backward and forward action and drive the deck frame 20 to perform the elevating and the folding action.

The transmission spindle 41 is screwed into a screw hole 441 for a pivotal connection with the slide shaft 44.

The slide shaft 44 is provided with a pulley 48, respectively, at two ends thereof. These two pulleys 48 are respectively mounted on the slide rail 121 of the main frame 10. Moreover, the respective end of the two elevating rods 45 is pivotally mounted on the slide shaft 44 while the other end thereof is pivotally mounted on the fixing shaft 23 of the deck frame 20.

One end of each of the folding supports 46 and the movable supports 47 is pivotally disposed at front end of each foot seats 12. The other end of each of the folding supports 46 is fixed at one side of the deck frame 20 while the other end of each of the movable supports 47 is inserted into the hole 25 of the deck frame 20 by means of a pull piece 49 to be in a pivotal connection. The pull piece 49 includes a pivotal rod 491 in which a resilient piece (not shown) is inserted.

Accordingly, the servomotor 42 brings the transmission spindle 41 into rotation to drive the slide shaft 44 to make a forward and a backward movement on the slide rail 121. Thus, a relatively elevating action of the deck frame 20 is created. If the deck frame 20 is inclined at a certain angle (see FIG. 3) and the other end of the movable supports 47 is pivotally fixed in the hole 25 of the deck frame 20, the forward and the backward sliding of the slide shaft 44 will enable the deck frame 20 to produce a relatively folding action (see FIG. 4).

Figure 3:
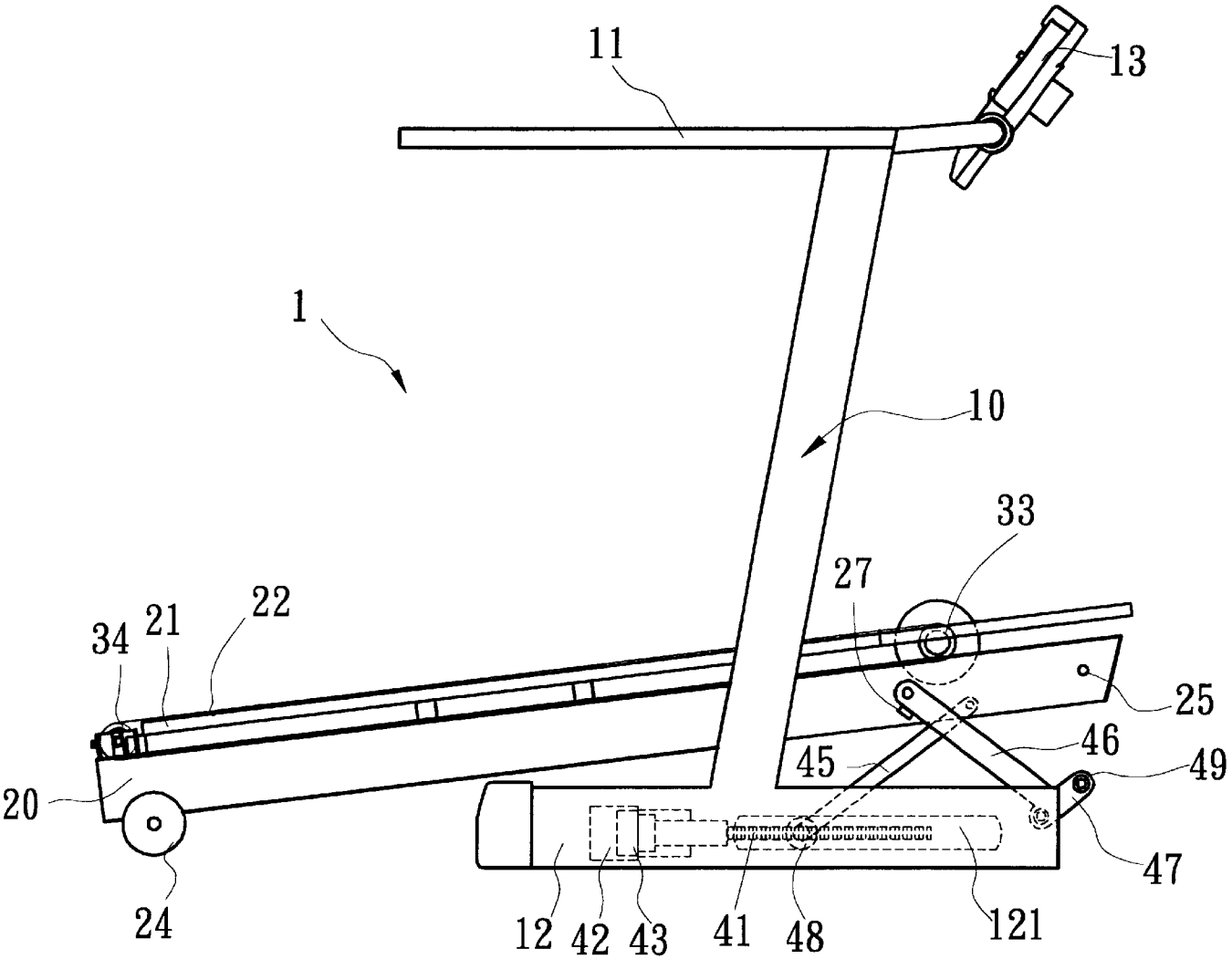
FIG. 3 is a schematic drawing of the first preferred embodiment of the present invention showing the elevating movement thereof.
Figure 4:
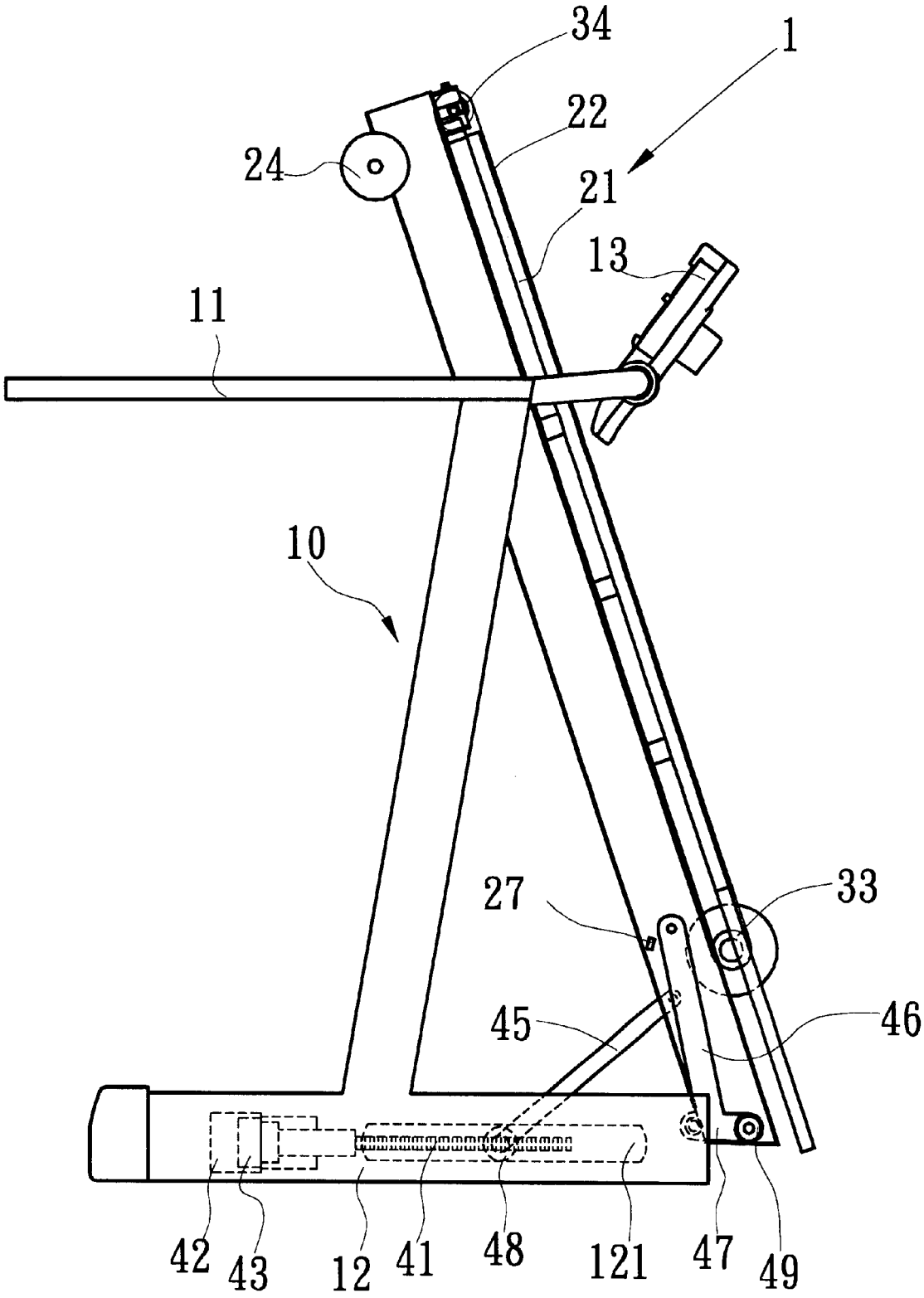
FIG. 4 is a schematic drawing of the first preferred embodiment of the present invention showing the folding movement thereof.

In using the exercise treadmill, as shown in FIGS. 3 and 4, the deck frame 20 is directly pushed by means of the slide shaft 44 for an elevating movement. In folding the exercise treadmill, the deck frame 20 and the main frame 10 are locked together by means of the pull piece 49. As a result, the deck frame 20 is folded by means that the movable supports 47 fixed at one end of the main frame 10 serve as pivoting center when the slide shaft 44 pushes the deck frame 20.

In order to prevent the deck frame 20 from a false action in the elevating or folding process, an electronic sensing switch 26 is provided in the hole 25 of the deck frame 20 and is connected with the power supply system (not shown) of the main motor 31. When the electronic sensing switch 26 contacts the movable supports 47, the power of the main motor 31 will be immediately disconnected.

In addition, a limit switch 27 is fitted at a proper position of two sides of the deck frame 20 and connected to the power supply (not shown) of the servomotor 42. This limit switch 27 is used to limit the maximal elevation angle of the deck frame 20 when the folding supports 46 is elevated to the preset height and in contact therewith. The optimal installation position and the using principle is dependent upon that the angle relationship between the folding supports 46 and the deck frame 20 is constant and fixed (see FIGS. 1 and 4) when the deck frame 20 performs the elevatingly folding action, and that a great change of the angle relationship between the folding supports 46 and the deck frame 20 is present (see FIGS. 1 and 3) when the deck frame 20 performs the height-adjusting action. As a result, the maximal elevation angle of the deck frame 20 can be decided by the above-mentioned angle change of the folding supports 46.

Figure 5:
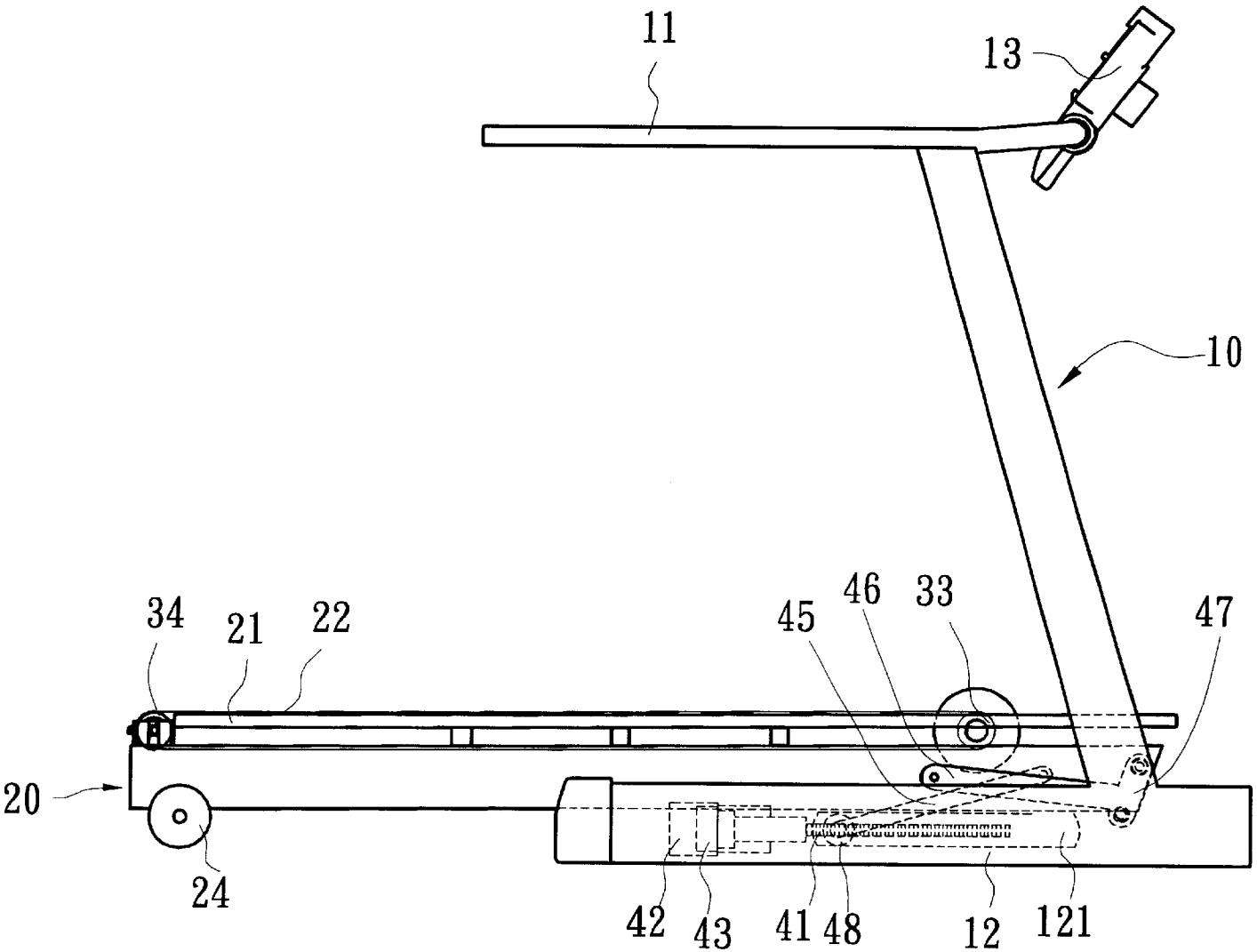
FIG. 5 is a schematic drawing of a second preferred embodiment of the present invention showing the folding movement thereof.
Figure 6:
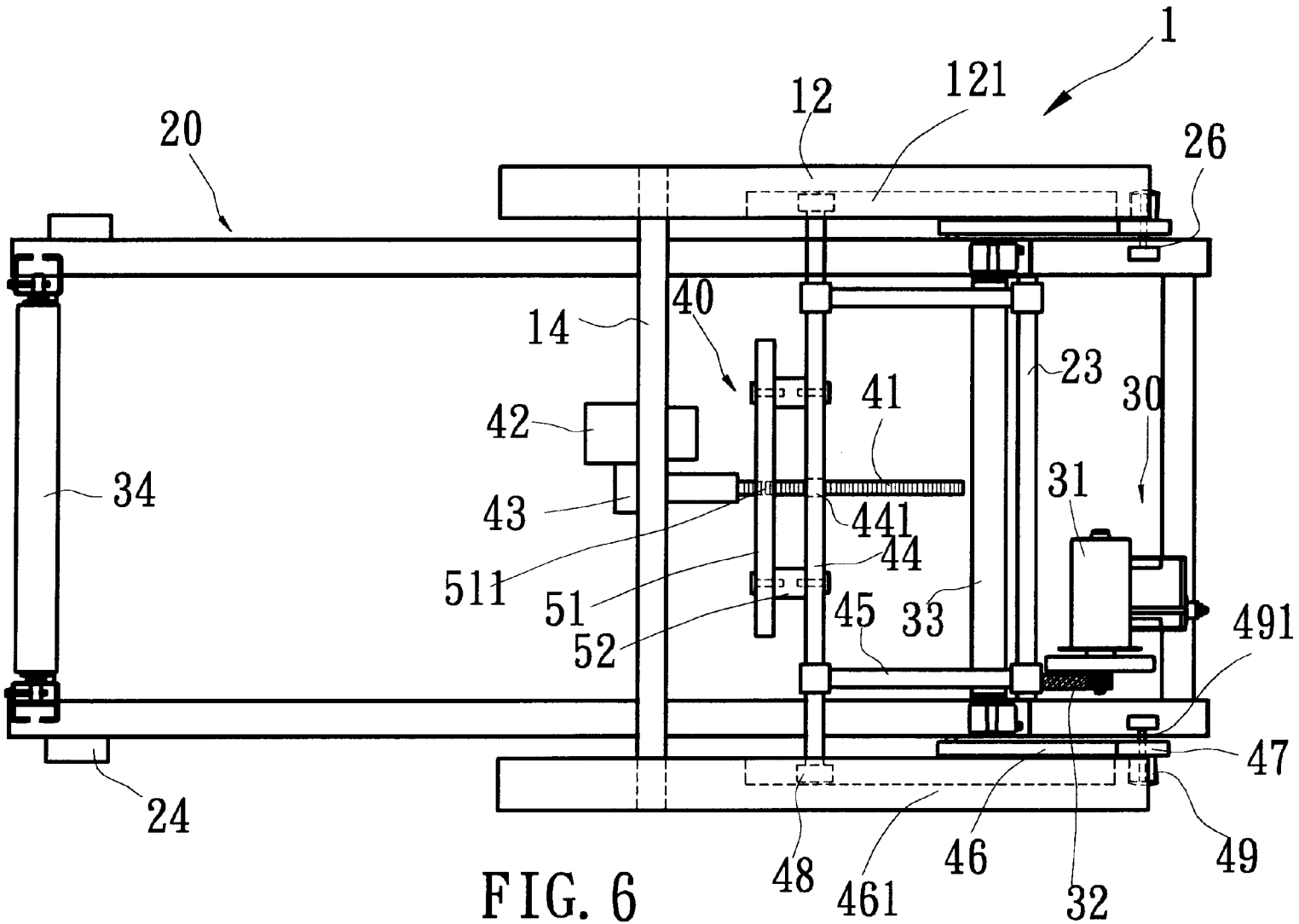
FIG. 6 is an assembly bottom view of the third preferred embodiment of the present invention.

Moreover, referring to FIGS. 5 and 6, the second preferred embodiment of the present invention differs from the first one in that one end of each of the movable supports 47 of the elevatingly folding unit 40 is directly pivotally fixed at a proper position of the main frame 10 without using the pull piece 49 for the pivotal fixing. Thus, when the slide shaft 44 moves forwards and backwards, the deck frame 20 will create only a relatively folding movement.

Furthermore, FIG. 6 shows the third preferred embodiment of the present invention which differs from the first and the second one in that the slide shaft 44 is pivoted with a transmission shaft 51 by means of two buffer rods 52. A transmission screw hole 511 is disposed at a proper position of the transmission shaft 51 while the slide shaft 44 is provided with a through hole 411. The transmission spindle 41 is inserted through the transmission screw hole 511 and the through hole 411 respectively. Accordingly, when the transmission spindle 44 rotates, the transmission shaft 51 will produce a pushing action for the forward and backward movement of the transmission spindle 44 in order to drive the deck frame 20 for performing the elevating or folding action. Meanwhile, the buffer rods 52 can be used to reduce the shaking of the deck frame 20 in elevating or folding. In addition, the buffer rods 52 are mounted on the transmission shaft 51 and the transmission spindle 44 by means of a few locking means.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An elevating folding electric exercise treadmill comprising:

a main frame having an inverted U-handrail and two opposing foot seats, a slide rail being disposed at two opposing inner sides;

a deck frame interposed between the two foot seats and including at least a deck thereon and a continuous belt mounted around said deck;

a belt-driving assembly mounted at one end of said deck frame, including a main motor driving a belt pulley which rotates a drive shaft to move said continuous belt; and, an elevating folding unit interposed between the two foot seats, and including: a servomotor driving a gear box which rotates a transmission spindle, said transmission spindle engaging a slide shaft with two pulleys such that said slide shaft undergoes forward and backward movement; two elevating rods pivotally mounted on said slide shaft, and pivotally mounted on a fixing shaft of said deck frame; a folding support and a movable support pivotally mounted between said deck frame and a foot seat of said main frame, whereby when said deck frame and two foot seats are fixed in one body, the deck frame is folded by moving said slide shaft and wherein the folding support and a movable support are pivotally mounted at one end of said foot seat are pivoted with said deck frame such that said deck frame undergoes a folding action.

2. The elevating folding electric exercise treadmill as claimed in claim 1, further comprising a control panel installed on said inverted U-handrail.

3. The elevating folding electric exercise treadmill as claimed in claim 1, wherein said slide shaft includes a screw hole engaged by said transmission spindle so that said slide shaft is movable when said transmission spindle rotates.

4. The elevating folding electric exercise treadmill as claimed in claim 1, wherein said movable support is pivotally connected to said deck frame by a removable pull piece wherein said pull piece comprises a pivotal rod which is inserted into a resilient member so that said pivotal rod can be flexibly pulled.

5. The elevating folding electric exercise treadmill as claimed in claim 1, further comprising an electronic sensing switch provided in a hole of said deck frame and connected with a power supply system of said main motor, wherein the power of said main motor will be disconnected when said electronic sensing switch contacts said movable supports.

6. The elevating folding electric exercise treadmill as claimed in claim 1, further comprising a limit switch on said deck frame and connected to said servomotor, such that, when a predetermined maximal elevation angle of said deck frame is reached and when said folding supports are elevated to a preset height the servomotor is turned off.

7. The elevating folding electric exercise treadmill as claimed in claim 1, further comprising a transmission shaft and at least two buffer rods wherein said transmission shaft pushes said slide shaft in motion when driven by said transmission spindle, and wherein said buffer rods reduce shaking when said deck frame is elevated or folded.

8. An elevating folding electric exercise treadmill comprising:

a main frame having an inverted U-handrail and two opposing foot seats, a control panel mounted on said inverted U-handrail, and a slide rail being disposed at two opposing inner sides;

a deck frame interposed between the two foot seats and including at least a deck thereon and a continuous belt mounted around said deck;

a belt-driving assembly mounted at one end of said deck frame, including a main motor driving a belt pulley which rotates a drive shaft to move said continuous belt; and, an elevating folding unit interposed between the two foot seats, and including: a servomotor driving a gear box which rotates a transmission spindle, to drive a slide shaft for forward and backward movement thereon; a pulley fitted at two ends of said slide shaft; two elevating rods pivotally mounted on said slide shaft, and pivotally mounted on a fixing shaft of said deck frame such that said deck frame is elevated by moving said slide shaft forward and backward; and a folding support and a movable support pivotally mounted at one end of a foot seat pivoted with said deck frame such that said deck frame undergoes a folding action.

* * * * *